US005352014A

United States Patent [19]

Allen

[11] Patent Number: 5,352,014

[45] Date of Patent: Oct. 4, 1994

[54] TABLE CONSTRUCTION

[76] Inventor: Carling D. Allen, 581 N. 640 West, Orem, Utah 84057

[21] Appl. No.: 167,149

[22] Filed: Dec. 16, 1993

[51] Int. Cl.[5] ..... A47B 83/02

[52] U.S. Cl. ..... 297/142; 297/143; 297/174

[58] Field of Search ..... 297/140–144, 297/174

[56] References Cited

U.S. PATENT DOCUMENTS

| | | | |
|---|---|---|---|
| 1,156,538 | 10/1915 | Markowicz | 297/142 |
| 1,182,850 | 5/1916 | Little | 297/142 |
| 3,547,484 | 12/1970 | Allen | 297/141 |
| 3,658,379 | 4/1972 | Black et al. | 297/142 X |

FOREIGN PATENT DOCUMENTS

| | | | |
|---|---|---|---|
| 532163 | 10/1954 | Belgium | 297/142 |
| 1574123 | 4/1980 | United Kingdom | 297/141 |

*Primary Examiner*—Peter R. Brown
*Attorney, Agent, or Firm*—M. Ralph Shaffer

[57] ABSTRACT

A table construction suitable for fabrication in elemental forms preparatory to break-down shipment and on-site assembly, when desired, and including suspended seating construction; the support structure of the table top incorporating the suspended seating takes the form of a hub and spoke construction of telescoping nature, the hub generally comprising a cross and the spokes telescoping therewith being provided with elements for attaching the support structure to the underside of the table top preparatory for table erection.

10 Claims, 4 Drawing Sheets

TABLE CONSTRUCTION

FIELD OF INVENTION

The present invention pertains to table constructions and, more particularly, to a new and improved table construction incorporating suspended seating and providing telescoping support structure, provided with such suspended seating, wherein the table or a majority of its component parts can be fabricated at the manufacturing location and shipped in disassembled form preparatory to convenient assembly and erection either at the ultimate intended site or at a retail location or distribution center.

DESCRIPTION OF PRIOR ART

There are many types of suspended seating table and counter constructions. The inventor's prior U.S. Pat. No. 3,457,484, which is fully incorporated by way of reference herein, illustrates one embodiment. Past constructions are generally large, bulky, heavy and are cumbersome to ship. Support structure must needs be strong, of metallic character, and therefore results in a somewhat heavy construction. No art is currently known to the inventor wherein the various parts can be manufactured and shipped in break-down, disassembled form preparatory for easy and convenient telescoping assembly at a distant location once primary shipment is completed.

BRIEF DESCRIPTION OF THE INVENTION

In accordance with the principles of the present invention, the table construction in, which also will include in the concept of "table," counters, bars and the like, has a support structure of multiple, telescoping component form. The telescoping pieces can be slipped together, depending upon the table configuration desired, and secured against slippage by, e.g., Allen screws or other types of attachments. In a preferred form of the invention, a hub and spoke form of telescoping tubular construction is provided, with the hub taking the form of a medial cross. Telescoping arms or spokes are secured thereto and are provided with legs at their extremities, as may be desired, and preferably articulative and spring-biased, and also with journals and other permissible structure for receiving seating structure to be supported by suck spokes. The cross and other elemental structures are convenient for separate fabrication and handling as well as convenient shipment in the flat. Such shipment can include the table or counter top, or this structure can be provided separately at the installation site.

OBJECTS

Accordingly, a principal object of the invention is to provide a new and improved suspended seating construction.

A further object is to provide a table or counter-top construction wherein the support structure accommodating legs, swivel and articulative support seating, and table top stabilization and support structure is made in modular, telescoping, and selectively secured form, whereby to accommodate ease of shipment and assembly.

A further object is to provided a suspended seating table construction wherein the tabletop support is of tubular telescoping construction, such support providing the support legs and suspended seating structure and being of a hub and spoke nature to facilitate sturdy support of the tabletop and at the same time provide for convenient shipping of all necessary structure in the flat for delivery to desired on-site locations.

IN THE DRAWINGS

The features of the present invention may best be understood by way of reference to the following detailed description, taken in conjunction with the accompanying drawings, in which.

DETAILED DESCRIPTION OF PREFERRED EMBODIMENTS

Figure 1:
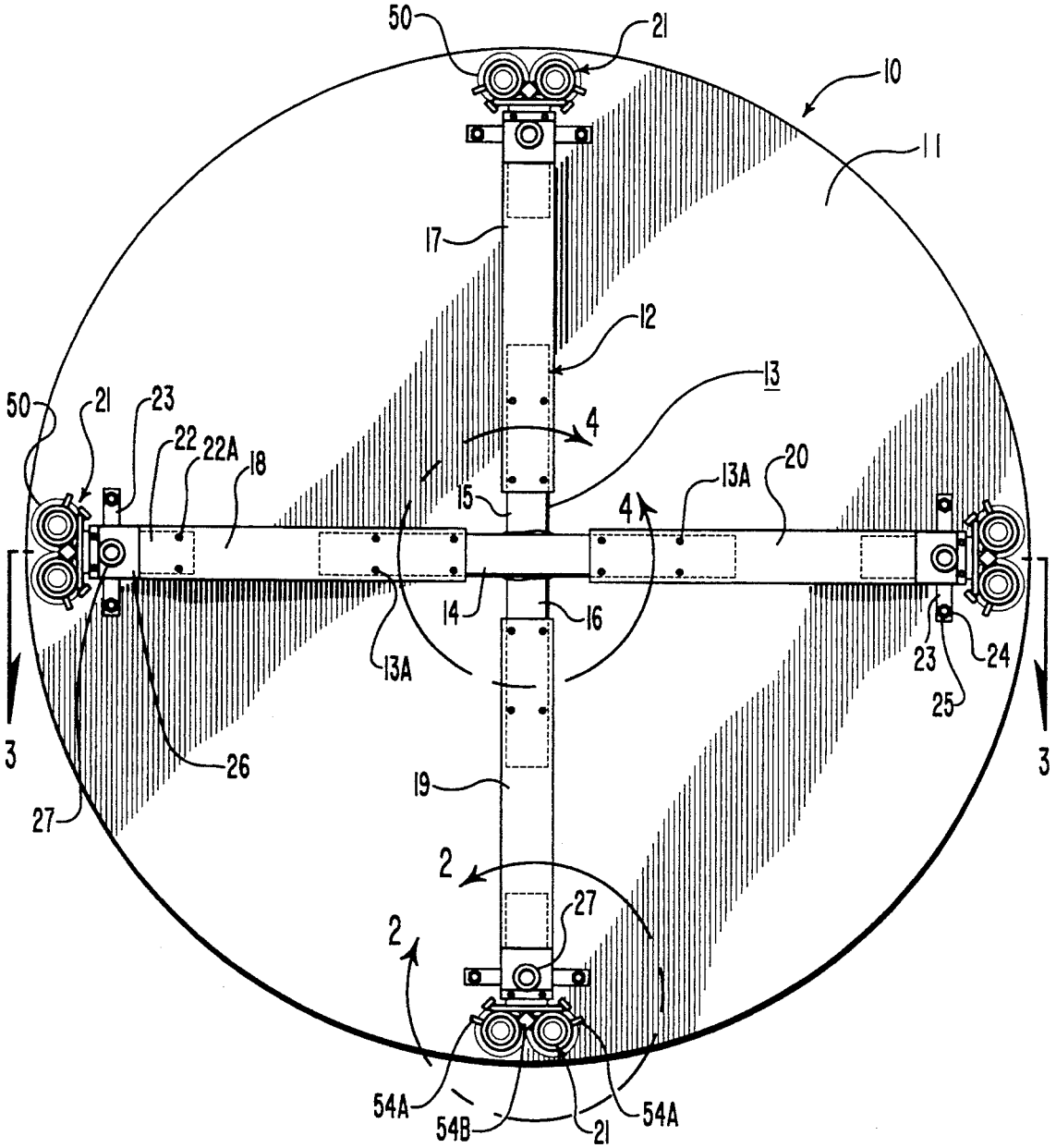
FIG. 1 is a bottom plan, looking up, of a table construction constructed in accordance with the principles of the present invention.

In FIG. 1 the table construction 10 includes table top 11, e.g., in round configurement as shown. The support construction 12 is provided to support table top 11. Support construction 12 includes a central hub preferably in the form of a cross 13. The latter includes tubular elements 14, 15 and 16, e.g. of square transverse cross-section, which are welded together and which form radial extensions. Spokes 17–20 are likewise tubular in form and preferably square as to transverse cross-section. These are telescopingly slipped over the extension elements 14–16 and are secured in place by a series of set screws 13A as indicated. The outermost extremities of spokes 17–20 are provided with respective chair mount constructions 21, the latter being provided with inwardly directed mounting stubs 22 that are secured in place, for example, by set screws 22A. The spokes 17–20 included upper transverse plates 23 which are welded in place and include apertures 24 receiving bolts or screws 25, the latter being threaded into table top 11. Bolted or otherwise secured to the underside of spokes 17–20 are respective plates 26, the latter being provided with depending cylindrical bosses 27. Positioned beneath and circumscribing the respective bosses 27 are respective legs 28, the latter including sleeves 29 being tack welded thereto at W. Sleeves 29 include, welded thereto, respective threaded members 30, the latter being supplied with leg adjustment, table leveling, positioning type screws 31. Positioning screws 31 are threaded through the members 30 at the upper end thereof and thus thrustingly and adjustably engage respective plates 26, this to accomplish a levelling function relative to the legs. Sleeves 29 and legs 28 are provided with aligned apertures 32 that are threaded and conjointly receive plural set screws 33. Thus, once the legs are in position over respective cylindrical bosses or stub shafts 27, the screws 31 can be adjusted for leveling purposes; subsequently, set screws 33 are tightened so as to secure the sleeves 29 and legs 28 to cylindrical bosses 27 against inadvertent rotative movement.

As to the spokes or elongate members 17–20, these may be provided with spacers or spacer plates 23A which in thickness are equivalent to the thickness of the respective transverse plates 23.

Figure 2:
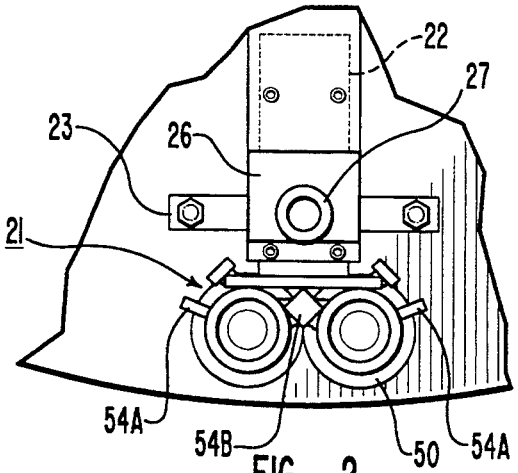
FIG. 2 is a fragmentary detail taken along the arcuate line 2—2 in FIG. 1, illustrating a dual chair construction at each seating location which, in the embodiment shown, are arranged in quadrature.
Figure 3:
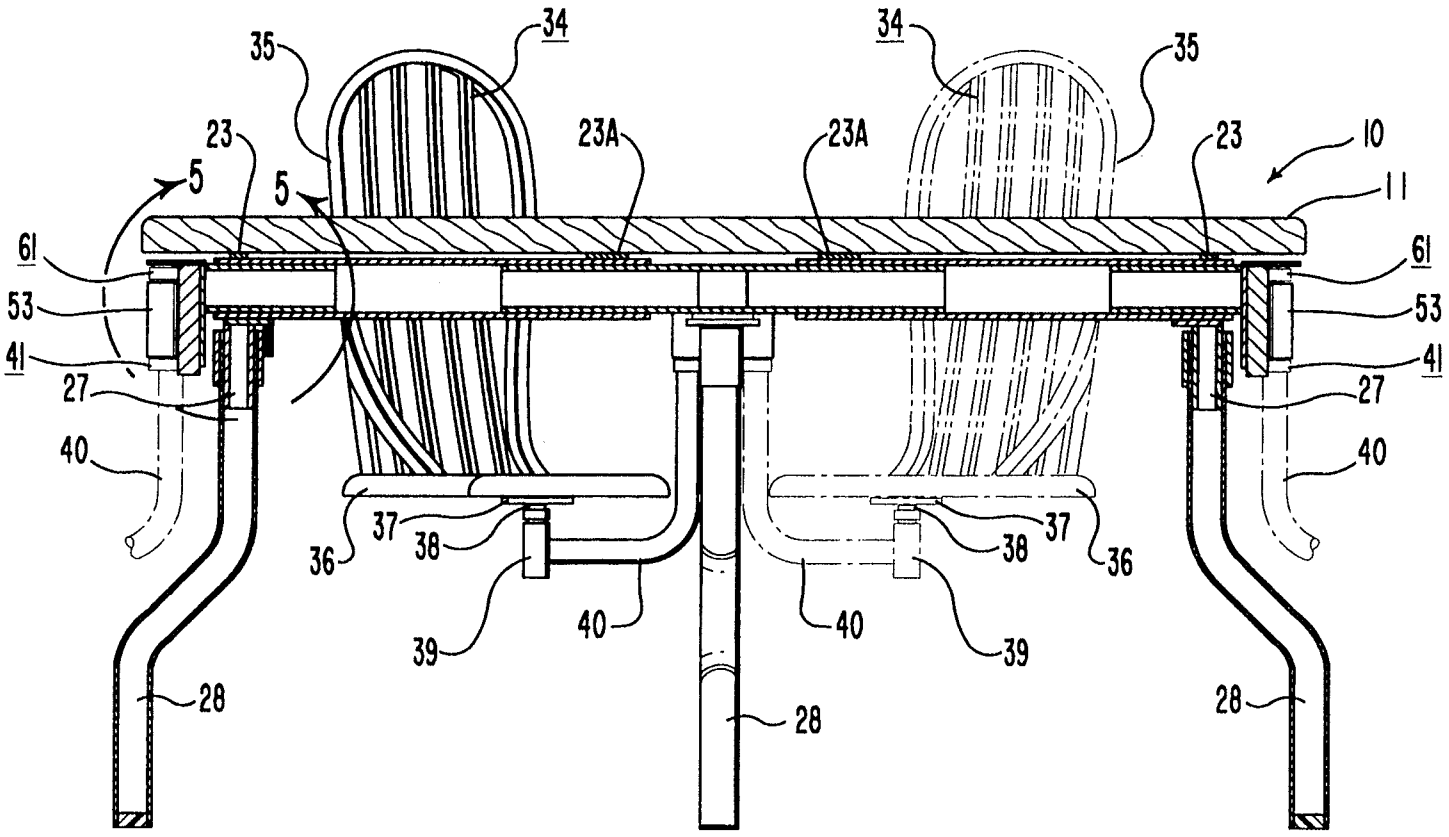
FIG. 3 is a longitudinal section taken along the line 3—3 in FIG. 1.
Figure 4:
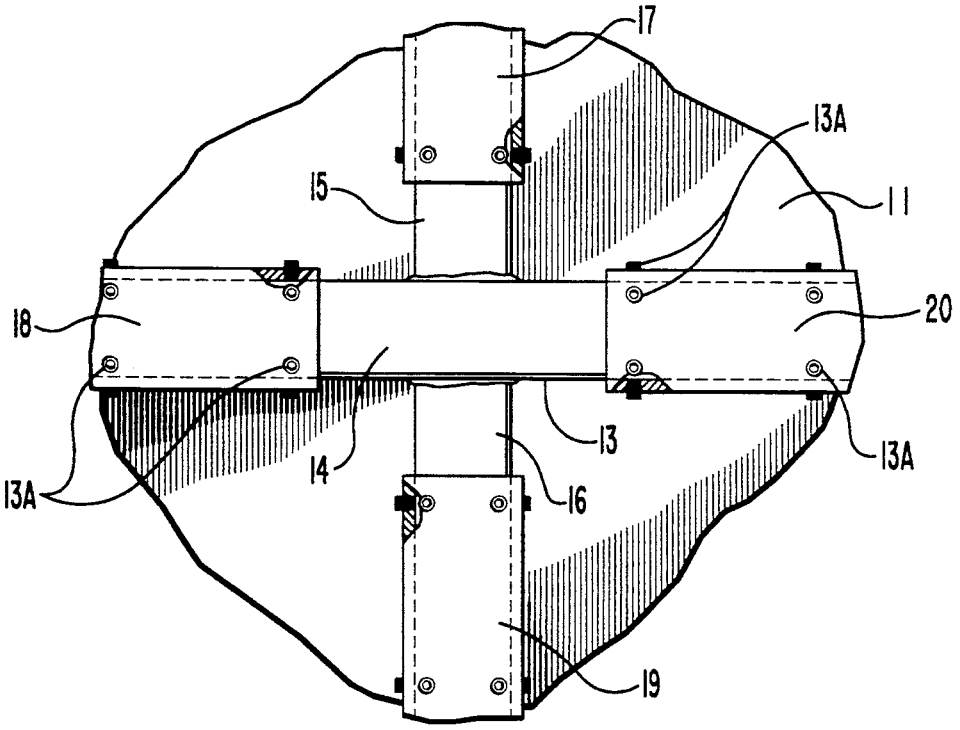
FIG. 4 is an enlarged detail taken along the arcuate line 4—4 in FIG. 1.
Figure 5:
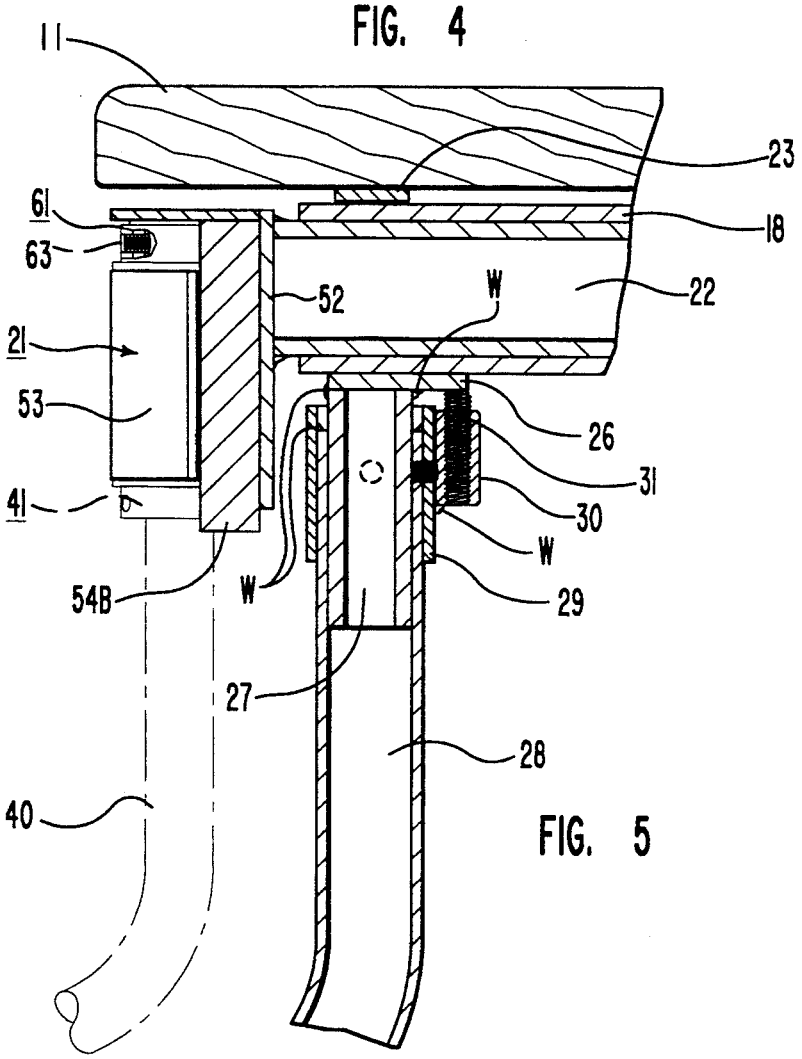
FIG. 5 is an enlarged detail taken along the arcuate line 5—5 in FIG. 3.
Figure 6:
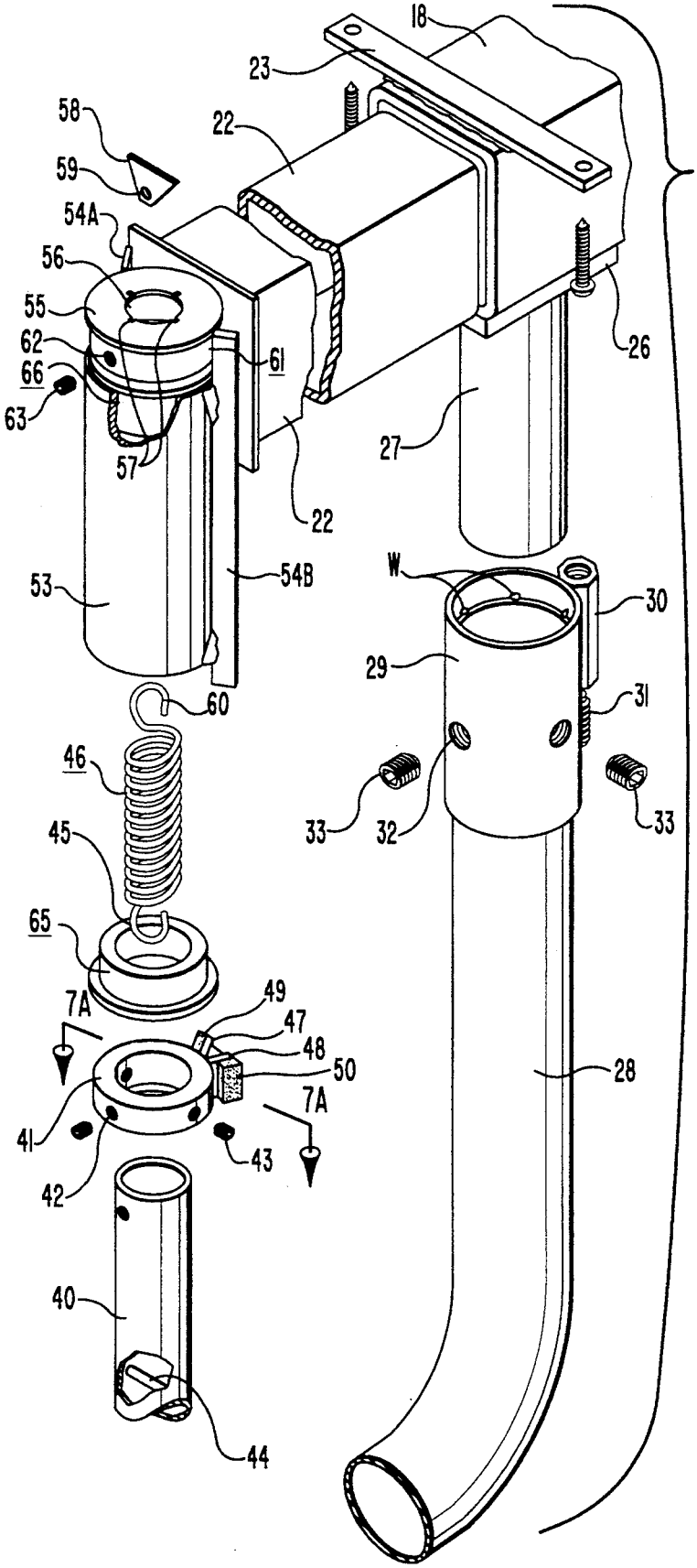
FIG. 6 is a perspective exploded view of representative seating and leg constructions that will be typical for both one-seat and two-seat construction per respective seating location in the invention.

At each leg station may be provided one or a pair of suspended seating constructions 34, each of which will include a chair 36 provided a seat 36. The underside of each of the seats 36 will include plate 37 provided with depending stub shaft 38. Stub shaft 38 fits into journal 39 which is supplied seating arm 40, located in pairs at each of the leg stations. At a lower portion of seating arm 40 is secured a collar 41 provided with apertures 42 for receiving set screws 43. An oil-impregnated bearing 65 has its circular flange disposed on the upper surface of collar 41 and its cylindrical body thrust upwardly into the lower end of tubular member 53. Correspondingly, the oil-impregnated bearing 66 has its cylindrical body positioned downwardly through the top of member 53 and its flange disposed on the upper lip of the latter. Collar 61 rests upon such flange of bearing 66 and is secured to the upper extremity of arm 40 by set screws 63 proceeding through apertures 62. Seating arm 40 includes an internal fixed pin 44, such as a roll pin, receiving the depending hook 45 of torsion spring 46. Collar 41 includes outwardly extending elemental plates 47 and 48 having bumper pads 49 and 50, of either plastic or rubber material, which co-act with stop plates 54A, 54B, shown also as a single element 54B in FIG. 2 for a respective, plural-seat station.. Mounting construction 21 can include one chair support construction, shown in FIG. 6, or a pair of chair mount constructions as shown at 50 in FIG. 1. Whether one or plural constructions are used, the fabrication can remain essentially the same. Thus, tubular portion 22 includes a plate 52 welded to the end thereof and provided with tubular member 53 having welded stop plates 54A and 54B which are welded to plate 52 and spring retainer ring 55. Tubular member 53 is thus provided with such a fixed ring 55 having a central aperture 56 and a series of notches 57 into which key 58 is placed selectively. This key is provided with an aperture 59 receiving the upper hook 60 of torsion spring 46. Different slots 57 can be utilized for positioning the key or spring retainer 58.

Collar 61 is shown to be provided with a threaded aperture 62 receiving a respective set screw 53. Set screws 43 and 63 can be employed to secure the collars 41 and 61 in place.

Figure 7A:
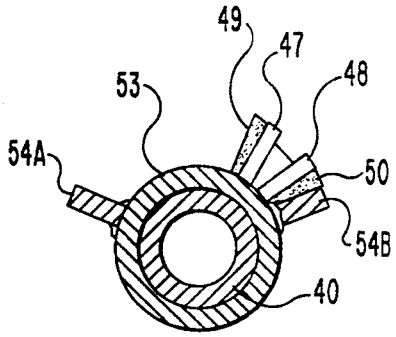
FIGS. 7A and 7B are cross-sectional views of the pivotal mount of the seating arm.
Figure 7B:
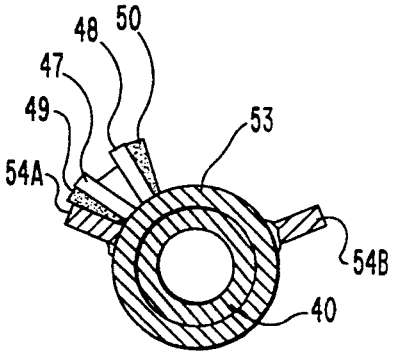

FIGS. 7A and 7B illustrate the rotation of respective seating arms 40 about their respective vertical axes whereby elements 49 and 50 come into play as stops to delimit the rotational displacement, in both directions, of the respective seating arms about their respective vertical axes.

In assembly and operation, the cross and spokes are independently fabricated, as are the chair and seat constructions and the attachment constructions, are shipped in the flat as component parts. Torsion springs 46 of course will affect the movement and restoring force applied to the chair constructions once occupants leave. On site or at a retail location, the various parts are telescopingly assembled, the set screws tightened and screws are employed to secure table top 11 to the support structure.

While particular embodiments have been shown and described, it will be obvious to those skilled in the art that various changes and modifications may be made without departing from the essential features of the invention and, therefore, the aim in the appended claims is to cover all such features and modifications as inhere in the true spirit and scope of the invention.

I claim:

1. A construction for supporting a table-type top including, in combination: a hub having plural horizontal extensions; spokes having outer extremities and telescopingly cooperating with and engaging said hub at said plural extensions, respectively; means for securing said spokes to said extensions of said hub against relative slidable movement therebetween, said extensions being provided with elements for securing an external table-type top thereto; respective legs depending from, secured to, and supporting said spokes proximate said outer extremities; plural seat constructions respectively positioned on said outer extremities of said spokes and above said legs, and plural means for respectively positively mounting respective ones of said seat constructions to respective ones of said spokes above and proximate respective ones of said legs.

2. A table construction including, in combination: a hub having plural horizontal extensions; essentially horizontal spokes having outer extremities and telescopingly cooperating with and engaging said hub at said plural extensions, respectively; means for securing said spokes to said extensions of said hub against relative slidable movement therebetween; respective legs depending from, secured to, and supporting said spokes proximate said outer extremities; a table top secured to and over said spokes; plural suspended seat constructions respectively positioned on said outer extremities of said spokes and above said legs, and plural means for respectively positively mounting respective ones of said seat constructions to respective ones of said spokes above and proximate respective ones of said legs.

3. A support construction for supporting an external table top and including, in combination: a tubular hub shaped in the form of a cross and having plural tubular extensions; tubular, essentially horizontal spokes having means for supporting said external table top and constructed to cooperate telescopingly with and engage said hub at said plural extensions, respectively; means for securing said spokes to said hub against relative slidable movement therebetween; respective legs secured to respective ones of said spokes and constructed to depend from and support said spokes; means for securing said legs to said spokes; respective suspended seat constructions positioned upon and mounted to said spokes above respective ones of said legs and constructed to mount, for pivotal movement, to respective ones of said spokes, and means for releasably connecting said suspended seat constructions to said spokes.

4. The support construction of claim 3 wherein said construction is provided a table top secured to said spokes.

5. The construction of claim 4 wherein said spokes are provided with upper transverse plates provided with apertures, and means for securing said spokes to said external table top at said apertures.

6. The construction of claim 4 wherein said table top, hub, spokes, and seat constructions constitute components comprising said construction, said construction including means for disassembly or breakdown such that said components may be separated for packaging purposes.

7. The construction of claim 4 wherein said spokes are provided, proximate their outer ends, respective underside plates having depending cylindrical tubular stub extensions, said legs comprising respective leg elements of curved configurement, the upper ends of said legs being provided with respective fixed sleeves cooperating with said stub extensions, and means for fixedly securing said legs at said sleeves to said stub extensions.

8. The construction of claim 7 wherein said sleeves each include a side-disposed internally threaded tube, and respective threaded adjustment bolts threadedly disposed in said tubes and thrustingly abutting said underside plates, for leg-height adjustment purposes.

9. The construction of claim 8 wherein said sleeves each include adjustment screws for releasably securing and fixing said sleeves to said stub extensions against inadvertent rotative movement.

10. A table construction including, in combination: a tubular cross; tubular elongate elements having outer extremities and arranged as spokes and disposed in telescoping engagement with said tubular cross; screw means for releasably securing said elements to said cross against mutual longitudinal slidable movement, said elements being provided at their respective said outer extremities with respective leg attachment structures; plural seat securement structures respectively secured to said outer extremities; seats respectively secured to said seat securement structures, each of said seats being provided with a seat support arm journalled in a respective one of said seat securement structures and having an upper portion, and a torsion spring coupling said upper portion to a respective one of said seat securement structures; and legs, provided with means to effect leg height adjustment and table leveling, respectively secured underneath and proximate said seat securement structures and to said leg attachment structures, respectively.

* * * * *